United States Patent [19]

Nomura et al.

[11] 4,364,369

[45] Dec. 21, 1982

[54] METHOD AND APPARATUS FOR RECIRCULATING EXHAUST GASES IN DIESEL ENGINE

[75] Inventors: Etsuji Nomura, Anjo; Hideaki Sasaya; Toshikuni Miyazaki, both of Okazaki, all of Japan

[73] Assignee: Nippon Soken, Inc., Nishio, Japan

[21] Appl. No.: 179,785

[22] Filed: Aug. 20, 1980

[30] Foreign Application Priority Data

Oct. 17, 1979 [JP] Japan ..... 54-134409

[51] Int. Cl.[3] ..... F02M 25/06

[52] U.S. Cl. ..... 123/569

[58] Field of Search ..... 123/569

[56] References Cited

FOREIGN PATENT DOCUMENTS 2658052 7/1978 Fed. Rep. of Germany ..... 123/569

*Primary Examiner*—Wendell E. Burns

*Attorney, Agent, or Firm*—Cushman, Darby & Cushman

[57] ABSTRACT

An exhaust gas recirculation apparatus for diesel engines includes an exhaust gas recirculation passage for recirculating exhaust gases from an exhaust pipe to an intake pipe, a valve body for controlling the cross sectional area of the recirculation passage and a pressure regulator for detecting an amount of fuel injection and to output a signal. A diaphragm device is operatively connected to the pressure regulator to receive a pressure signal to control the position of the valve body, whereby in response to an increase of fuel injection the cross sectional area of the recirculation passage is decreased.

5 Claims, 4 Drawing Figures

METHOD AND APPARATUS FOR RECIRCULATING EXHAUST GASES IN DIESEL ENGINE

BACKGROUND OF THE INVENTION

The present invention relates to a method and apparatus for recirculating exhaust gases in a diesel engine so as to suppress the emission of especially nitrogen oxides (NOx).

In order to suppress the emission of nitrogen oxides from internal combustion engines of automobiles, there have been widely used a variety of exhaust gas recirculation apparatus in which part of the exhaust gases is recirculated into an intake system. In the case of diesel engines, an exhaust gas recirculation ratio, that is, the ratio of the quantity of exhaust gases to be recirculated to the quantity of intake air plus the quantity of exhaust gases to be recirculated, is in general decreased with the increase in the load on the engine. In practice, with the prior art exhaust gas recirculation apparatus for the diesel engines, the exhaust gas recirculation ratio has been controlled in response to pushing down of the accelerator pedal.

With such prior art apparatus, the exhaust gas recirculation ratio is controlled in response to variations in load on the engine with the load corresponding to the amount of depression of an accelerator pedal in the case where the pedal is to be operated in response to variations, in the load to maintain a running speed of the engine constant. When the accelerator pedal is maintained at a predetermined stroke, however, variations in the load may cause variations in the rotational speed of the engine, but not in the exhaust gas recirculation ratio. Thus the prior art exhaust gas recirculation apparatus cannot attain any control of the exhaust gas recirculation ratio in response to the load over the entire operating conditions of the engine while such control is performed in response to the load only under the limited operating conditions.

It is an object of the present invention to eliminate the disadvantages of the prior art apparatus by controlling an amount of recirculating exhaust gases in response to an amount of fuel injection based on the fact that an amount of fuel injection is closely related to a load on a diesel engine.

DESCRIPTION OF THE PREFERRED EMBODIMENTS

Figure 1:
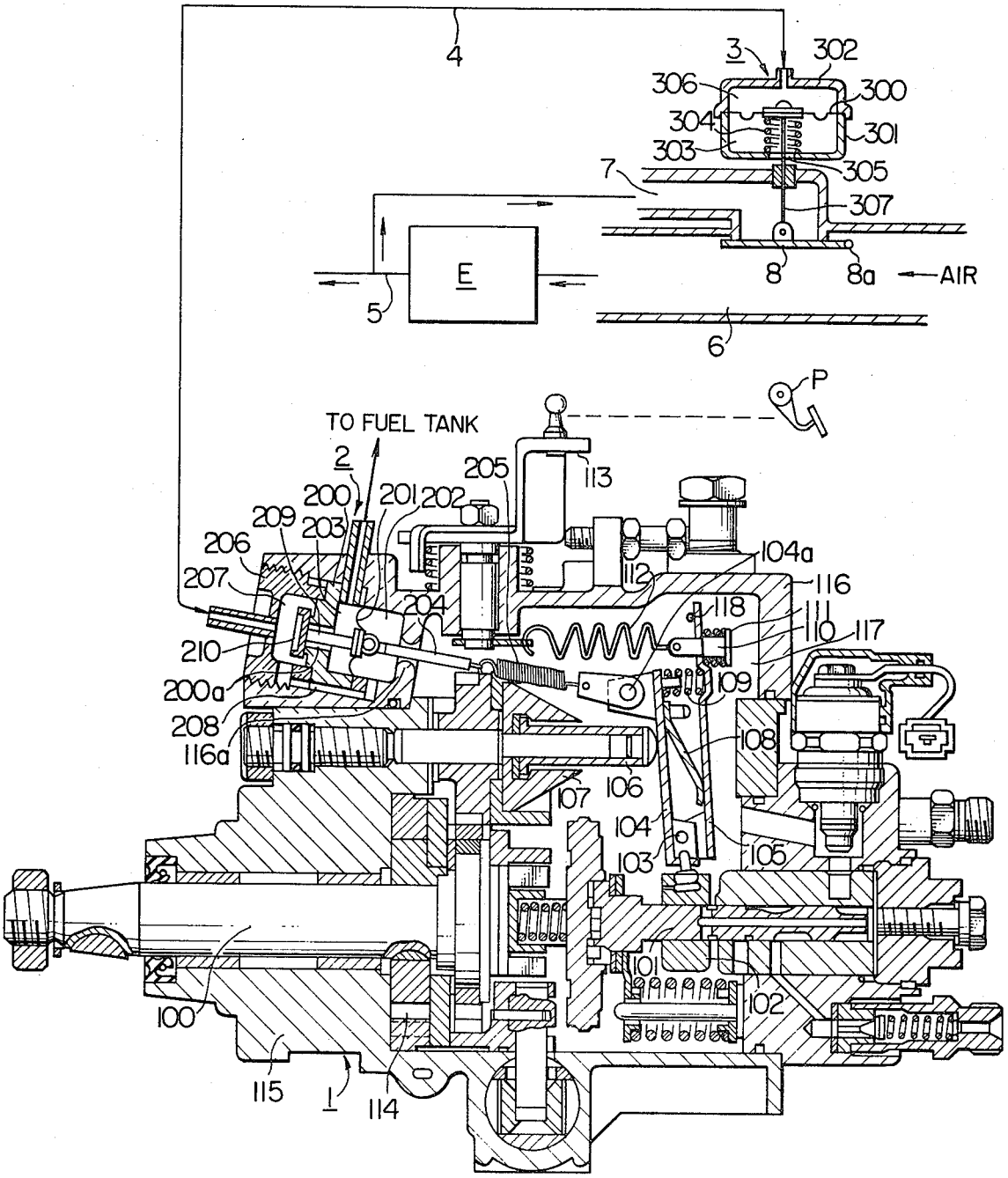
FIGS. 1 to 4 shows sectional views of respective exhaust gas recirculation apparatus according to first to fourth embodiments of the present invention.

In FIG. 1 is shown an exhaust gas recirculation apparatus in accordance with a first embodiment of the present invention. A conventional distributor type fuel injection pump 1 incorporates therein a pressure regulator device 2 of the present invention and is of the type in which upon rotation of a pump cam shaft 100 in synchronism with a multi-cylinder diesel engine E a plunger 101 is reciprocatingly rotated so that fuel is distributed and charged under pressure into the combustion chambers of the engine E. An amount of fuel injection is determined depending upon the position of a spill ring 102 slidably fitted over the plunger 101 which spill ring 102 is shifted by a control lever 104 pivotally mounted at its intermediate portion on a shaft 103. A tension lever 105 which is disposed in opposed relationship with the control lever 104 is pivotally mounted at its one or lower end on the shaft 103 for swinging movement thereabout, and is limited in its movement in the counterclockwise direction by a stopper 118. A governor sleeve 106 disposed on the opposite of the control lever 104 opposite to the tension lever 105 is adapted to be moved rightward in the figure by the centrifugal force developed when a flyweight 107 is rotated in synchronism with the engine E. In order to cope with the centrifugal force of the flyweight 107, a start spring 108 and an idle spring 109 are interposed between the control and tension levers 104 and 105. A damper spring 111 is provided between the tension lever 105 and a spring seat or retainer 110 to which is attached one end of a control spring 112. The initial tension or force of the control spring 112 can be arbitrarily varied by means of an adjusting lever 113 which in turn is operatively connected to an accelerator pedal P. When a driver pushes the accelerator pedal down, the initial force of the control spring 112 is increased so that the damper spring 111 is forced to be compressed.

A feed pump 114 which is driven in synchronism with the pump cam shaft 100 forces fuel into a chamber 117 defined by a pump housing 115 and a pump cover 116.

The pressure regulator 2 constitutes means for generating a control signal and a diaphragm device 3 constitutes driving means. The pressure regulator 2 has a diaphragm 201 interposed between the pump cover 116 and a diaphragm housing 200. A first chamber 202 defined on one side of the diaphragm 201 is communicated with the pump chamber 117 of the pump 1 through a hole **116*a* formed through a wall of the pump cover 116 while a second chamber 203 defined on the other side of the diaphragm 200 is communicated with a low pressure area in the suction port of the fuel pump 1** or a fuel tank (not shown).

A first rod 204 securely attached at its one end to the diaphragm 201 is extended through the hole **116*a* into the pump chamber 117 so that the cross sectional area of an annular fuel passage defined between the rod 204 and the hole 116*a* is very small. The other end of the first rod 204 is connected to one end of a modulator spring 205, the other end of which is connected to a pin 104*a* extended from the control lever 104. The modulator spring 205** has a small spring force.

A cover 206 is screwed into the pump cover 116, so that a third chamber 207 is defined between the cover 206 and the diaphragm housing 200. The third chamber 207 is communicated with the first chamber 202 through a passage 208 and can be communicated with the second chamber 203 through a hole **200*a* formed through the wall of the diaphragm housing 200** as will be described in detail below.

A second rod 209 extended through the hole **200*a* is securely attached at its one end to the diaphragm 201 and at the other end to a valve body 210 in the third chamber 207. Therefore as the diaphragm 201 deflects itself, the valve body 210 establishes or interrupts communication between the second and third chambers 203 and 207 through the hole 200*a***.

The diaphragm device 3 comprises a housing 301, a cover 302 and a diaphragm 300 interposed therebetween. A compression spring 304 is disposed in a lower chamber 303 defined by the diaphragm 300 and the housing 301 to biase the diaphragm 300 upward. The lower chamber 303 is communicated to the atmosphere through a vent 305 while an upper chamber 306 defined by the diaphragm 300 and the cover 302 is communicated through a conduit 4 with the third chamber 207 of the pressure regulator 2.

An exhaust pipe 5 of the engine E is communicated with an intake pipe 6 through an exhaust gas recirculation pipe or passage 7 whose discharge end is connected to the intake pipe 6 and opened or closed by a valve body 8. The valve body 8 is carried for pivotal movement by a shaft 8*a* in the intake pipe 6. More specifically, a shaft or a valve rod 307 securely attached at its one end to the diaphragm 300 is extended through the vent 305 and the wall of the recirculation passage 7 and is joined to the valve body 8 substantially at the center thereof. Therefore in response to upward or downward deflection of the diaphragm 300, the discharge end of the recirculation passage 7 connected to the intake pipe 6 is closed or opened by the valve body 8.

Next the mode of operation of the first embodiment with the above-described construction will be described. FIG. 1 shows a condition in which the engine E is stopped and the accelerator pedal is pushed down to the maximum. Under these conditions, the control spring 112 which has now the maximum initial tension or force pulls the tension lever 105 in the counterclockwise direction until it engages with the stopper 108. As a result, the control lever 104 is caused through the starter spring 108 by the tension lever 105 to rotate about the pivot pin 103 in the counterclockwise direction until it engages with the free end of the governor sleeve 106. Thus the flyweights 107 are completely closed and the spill ring 102 is caused to move rightward in FIG. 1, so that the amount of fuel injection becomes maximum to facilitate starting the engine E.

As the engine E is started to cause the flyweight 107 to produce a centrifugal force, the governor sleeve 106 is forced to move rightward, causing the control lever 104 to swing in the clockwise direction against the start spring 108 and the idle spring 109 and consequently the spill ring 102 is caused to move leftward to reduce an amount of fuel injection.

As the rotational speed of the engine E increases, thrust imparted to the governor plunger 106 by the flyweight 107 overcomes a tension of the control spring 112, so that both the control lever 104 and the tension lever 105 are forced to swing in the clockwise direction and the spill ring 102 is further shifted leftward to additionally reduce an amount of fuel injection. As described above, the angle of rotation of the control lever 104 about its pivot pin 103 corresponds to a load on the engine E or an amount of fuel injection.

With the pressure regulator 2, the pressure in the second chamber 203 is substantially equal to the atmospheric pressure while the fuel pressure communicated through the hole 116*a* to the first chamber 202 acts on the diaphragm 201 to bias the same leftward. When the initial tension of the modulator spring 205 is overcome, the diaphragm 201 and hence the valve body 210 are moved leftward. Then the second and third chambers 203 and 207 are communicated with each other through the holes 200*a*, so that the pressure in the third chamber 207 drops and consequently the pressure in the first chamber 202 also drops. As a result, the diaphragm 201 is returned back to its initial position, so that communication between the second and third chambers 203 and 207 is interrupted again by the valve body 210 being seated against its seat. The fuel under pressure again flows into the first chamber 202 through the hole 116*a* to raise the pressure therein. Thus it is seen that the pressure in the first chamber 202 corresponds to the initial tension of the modulator spring 205. When the load on the engine E is increased, the control lever 104 is forced to swing in the counterclockwise direction, thereby increasing an amount of fuel injection. When the load is decreased on the other hand, the lever 104 is swung in the clockwise direction. Thus the greater the load on the engine E, the lesser the load applied to the other end of the modulator spring 205 becomes and consequently the lesser the pressures in both the first and second chambers 202 and 207 become. Thus the pressure in the first chamber 202 is in proportion to the load on the engine E.

The pressure in the third chamber 207 of the pressure regulator 2 is communicated through the conduit 4 to the upper chamber 306 of the diaphragm device 3. When the load on the engine E is large, the force tending to bias the diaphragm 300 downward becomes small to reduce the opening degree of the valve body 8. As a result, the amount of exhaust gases to be recirculated is decreased. Thus an amount of exhaust gases to be recirculated can be controlled accurately in proportion to the load on the engine E.

Instead of coupling the control lever 104 with the valve body 8 through the pressure regulator 2 and the diaphragm device 3, they can be directly connected with each other through a suitable linkage. In this case, however, a relatively large mechanical force is needed to operate the valve body 8, so that the operation of the fuel injection pump 1 itself is adversely affected. With the embodiment as shown in FIG. 1, however, the control lever 104 is connected to the diaphragm 201 of the pressure regulator 2 through the modulator spring 205 with a relatively low initial tension to produce a pressure signal in proportion to the load applied to the modulator spring 205, which signal is transmitted to the valve body 8. Therefore even when the pressure signal transmitted to the upper chamber 306 from the pressure regulator 2 is weak, a relatively large force for driving the valve body 8 can be developed corresponding to a pressure receiving area of the diaphragm 300. Thus the adverse effects caused by the direct mechanical coupling between the control lever 104 and the valve body 8 can be completely eliminated.

In the first embodiment described above, the more an amount of fuel injection, the lesser the load applied to the modulator spring 205 of the pressure regulator 2 and consequently the lower the pressure in both the first and third chambers 202 and 207 becomes. Alternatively, the apparatus can be constructed such that the more an amount of fuel injection becomes, the larger the load applied to the modulator spring 205 becomes. In the latter case, the pressure signal from the pressure regulator 2 must be transmitted to the lower chamber 303 and the bias spring 304 must be disposed in the upper chamber 306.

Figure 2:
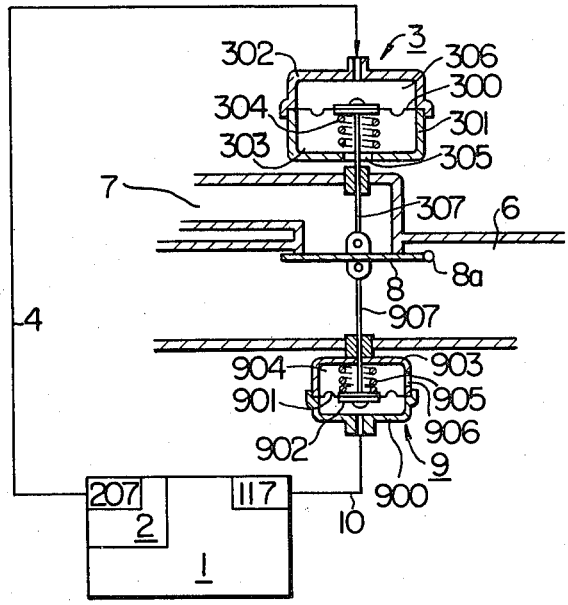

In FIG. 2 is shown a second embodiment of the present invention which further comprises in addition to the diaphragm device 3 a second diaphragm device 9 for driving the valve body 8. The second diaphragm device 9 comprises a cover 900, a housing 903, a diaphragm 901 interposed between them, a bias spring 905 for normally biasing the diaphragm 901 downward and a second shaft or valve rod 907 having its one end securely connected to the diaphragm 901 and the other end to the valve body 8. An upper chamber 904 defined between the diaphragm 901 and the housing 903 is communicated through a vent hole 906 to the atmosphere while a lower chamber 902 defined between the cover 900 and the diaphragm 901 is communicated through a duct 10 with and supplied with fuel from the pump chamber 117. The second diaphragm device 9 is mounted in relation to the valve body 8 such that the first and second shafts or valve rods 307 and 907 are aligned with each other.

When the pressure in the pump chamber 117, that is, the pressure of fuel delivered by the feed pump 114 (See FIG. 1) is varied depending upon the rotational speed of the engine E, the pressure in the third chamber 207 in the pressure regulator 2 may vary depending not only upon the force of the modulator spring 205 (See FIG. 1), but also upon the pressure of the fuel itself (to be referred to as the primary pressure). As a result the pressure transmitted to the chamber 306 of the first diaphragm device 3 will be varied depending not only upon the load on the engine E but also upon the rotation speed thereof. With the arrangement of the second embodiment, even when the fuel pressure rises excessively and the pressure introduced into the chamber 306 is also increased above a predetermined pressure to drive the valve body 8 downward, the fuel pressure transmitted from the pump chamber 117 to the lower chamber 902 of the second diaphragm device 9 acts as a force tending to deflect the diaphragm 901 upward to thereby drive the valve body 8 upward. Accordingly, the opening degree of the valve body 8 can be maintained at a predetermined valve corresponding to the load on the engine. To this end, the pressure receiving areas of the diaphragms 300 and 901 and the spring constants of the bias springs 304 and 905 must be determined theoretically and experimentally.

Figure 3:
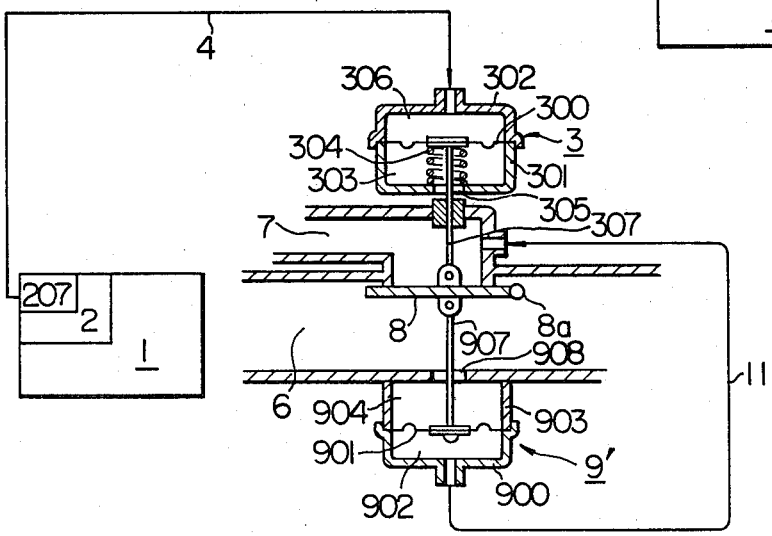

In FIG. 3 is shown a third embodiment of the present invention which is similar in construction to the second embodiment of FIG. 2. A second diaphragm device 9 of FIG. 3 is different from the second diaphragm device 9 of FIG. 2 in that the bias spring 905 is eliminated; the upper chamber 904 has no vent hole 906; the lower chamber 902 is disconnected from the pump chamber 117 and is communicated through a conduit 11 with the exhaust gas recirculation passage 7; and the upper chamber 904 is communicated with the intake pipe 6 through an opening 908 formed through the wall thereof so that a negative pressure is transmitted to the upper chamber 904.

In general, the higher the rotational speed of the engine, the higher the exhaust gas pressure and the intake pressure become. As the rotational speed of the engine increases, the diaphragm 901 of the diaphragm device 9' deflects itself upward to raise the valve body 8. As a result, the same effects as those of the second embodiment can be attained.

According to the second and third embodiments of the present invention described above, the amount of exhaust gases to be recirculated is controlled depending not only upon the load on the engine but also upon the rotational speed thereof. For instance, if it is desired to decrease an amount of exhaust gases to be recirculated when the engine is running at high speeds, the pressure receiving area of the diaphragm 901 suffices to be somewhat larger than a set value.

In the case of the first embodiment, both the negative intake pressure and the exhaust gas pressure increase in magnitude with the increase in the rotational speed of the engine, so that the valve body 8 is liable to erroneously be opened. With the second and third embodiments, however, such phenomenon can be readily coped with.

Figure 4:
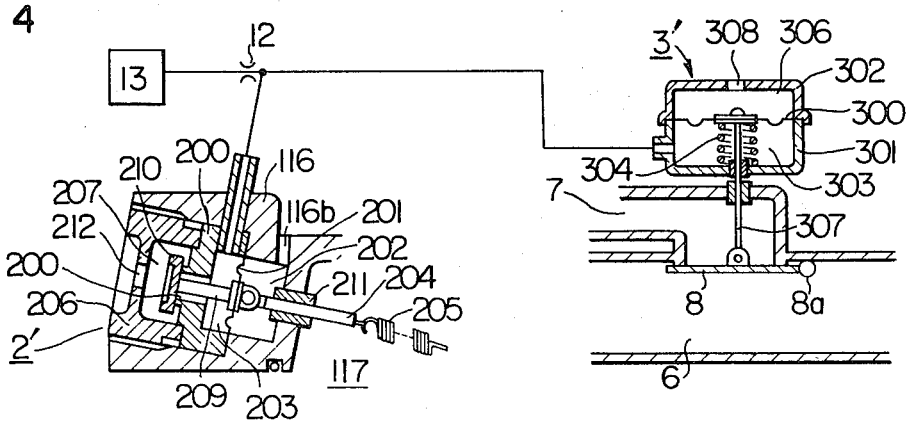

In FIG. 4 is shown a fourth embodiment of the present invention which is substantially similar in construction to the first embodiment shown in FIG. 1 except that the pressure regulator 2 and the diaphragm device 3 are somewhat modified as described below. In the modified pressure regulator 2', a bushing 211 is provided for holding the first rod 204 in a sealed manner to separate the first chamber 202 from the pump chamber 117, and the first chamber 202 is communicated to the atmosphere through a hole **116*b* formed through the wall of the pump cover 116. In addition, the third chamber 207 is also communicated to the atmosphere through a hole 212 formed through the cover 206. The second chamber 203 is communicated through a restriction 12 to a negative pressure source 13 such as a vacuum pump. In the modified diaphragm device 3', the upper chamber 306 is communicated to the atmosphere through a hole 308 formed through the top wall of the cover 302 while the lower chamber 306 is communicated with the second chamber 203 of the modified pressure regulator 2'**.

As is the case of the first embodiment, the negative pressure in the second chamber 203, varied depending upon the force of the modulator spring 205, is introduced into the lower chamber 303 of the modified diaphragm device. As a result, the same effects as those of the first embodiment can be also attained.

While the present invention has been described in detail in conjunction with the distributor type fuel injection pump, it is to be understood that the present invention can be also equally applied to in-line type injection pumps each having the same number of pump units as that of engine cylinders. In the latter case, the force of the modulator spring 205 suffices to be varied depending upon the position of a control rack or a member associated therewith.

In addition, the position of the spill ring 102 or the control rack can be detected by a conventional electrical or electronic sensor such as an operational transformer, potentiometer or the like, and the valve body 8 can be operated by an electric prime mover such as a linear solenoid coil or motor in response to the output signal from the sensor.

As described above, according to the present invention, the cross sectional area of the exhaust gas recirculation passage interconnecting between the exhaust gas pipe and the intake pipe is reduced with an increase in an amount of fuel injection which in turn is closely related to the load on the diesel engine. Therefore the amount of exhaust gases to be recirculated can be accurately controlled in response to the load on the engine regardless of its operating conditions.

What is claimed is:

1. An exhaust gas recirculation apparatus for a diesel engine having a fuel injection pump, comprising:

an exhaust gas recirculation passage for recirculating exhaust gases from an exhaust pipe to an intake pipe;

a valve body for controlling the cross-sectional area of said exhaust gas recirculation passage;

a fuel pressure regulator for detecting an amount of fuel injected by the fuel pump and for transmitting a fuel pressure signal; and means for driving said valve body including diaphragm means adapted to be actuated in response to said fuel pressure signal whereby, in response to an increase of fuel injection, the cross-sectional area of said exhaust gas recirculation passage is decreased;

said fuel pressure regulator including a diaphragm defining a first chamber on one side thereof and a second chamber on the other side thereof, a first rod securely attached at its one end to said diaphragm, a cover defining therein a third chamber adapted to be communicated through a passage with said second chamber and a second rod securely attached at its one end to said diaphragm and having said valve body mounted at its other end, said second chamber being in communication with a low pressure in the suction port of the fuel injection pump, said valve body serving to selectively establish communication between said second and third chambers.

2. An exhaust gas recirculation apparatus as set forth in claim 1 wherein said driving means further includes second diaphragm means which is actuated in response to fuel pressure delivered from said fuel injection pump.

3. An exhaust gas recirculation apparatus for a diesel engine having a fuel injection pump, comprising:

an exhaust gas recirculation passage for recirculating exhaust gases from an exhaust pipe to an intake pipe;

a valve body for controlling the cross-sectional area of said exhaust gas recirculation passage;

a fuel pressure regulator for detecting an amount of fuel injected by the fuel pump and for transmitting a fuel pressure signal; and means for driving said valve body, whereby in response to an increase of fuel injection, the cross-sectional area of said exhaust gas recirculation passage is decreased, said driving means including first diaphragm means adapted to be actuated in response to said fuel pressure signal and second diaphragm means which is actuated in response to a pressure difference between an exhaust gas pressure transmitted from said exhaust gas recirculation passage and a negative intake pressure transmitted from said intake pipe.

4. An exhaust gas recirculation apparatus as set forth in claim 1 or 3 wherein said fuel pressure regulator includes a rod connected through a mechanical linkage to a spill ring which in turn is mounted on the plunger of the fuel injection pump.

5. An exhaust gas recirculation apparatus as set forth in claim 4 wherein said rod is connected through a modulator spring to the mechanical linkage.

* * * * *